US009506284B2

(12) United States Patent
Braverman et al.

(10) Patent No.: US 9,506,284 B2
(45) Date of Patent: Nov. 29, 2016

(54) AUTOMATIC DOOR SYSTEM WITH DOOR SYSTEM USER INTERFACE

(75) Inventors: Jonathan M. Braverman, Unionville, CT (US); Michael S. Tignor, Watertown, CT (US); Michael A. Salvietti, Northfield, CT (US); Anthony R. Ranaudo, Bethlehem, CT (US)

(73) Assignee: Stanley Black & Decker, Inc., New Britain, CT (US)

( * ) Notice: Subject to any disclaimer, the term of this patent is extended or adjusted under 35 U.S.C. 154(b) by 965 days.

(21) Appl. No.: 13/300,839

(22) Filed: Nov. 21, 2011

(65) Prior Publication Data

US 2013/0127590 A1 May 23, 2013

(51) Int. Cl.

| | |
|---|---|
| ***G08B 29/00*** | (2006.01) |
| ***E05F 15/70*** | (2015.01) |
| ***E05F 15/79*** | (2015.01) |

(52) U.S. Cl.

CPC ..... *E05F 15/70* (2015.01); *E05F 15/79* (2015.01); *E05Y 2400/456* (2013.01); *E05Y 2400/81* (2013.01)

(58) Field of Classification Search

CPC .... E05F 15/79; E05F 15/70; E05Y 2400/81; E05Y 2400/456

USPC ..... 340/426.28, 5.7, 5.71, 546.1, 340/545.6–545.9, 5.72; 318/162

See application file for complete search history.

(56) References Cited

U.S. PATENT DOCUMENTS

| | | | |
|---|---|---|---|
| 4,148,092 | A | 4/1979 | Martin |
| 4,721,954 | A | 1/1988 | Mauch |
| 4,808,995 | A | 2/1989 | Clark et al. |
| 5,070,442 | A | 12/1991 | Syron-Townson et al. |
| 5,127,190 | A | 7/1992 | Hein et al. |
| 5,453,736 | A | 9/1995 | Noren |
| 5,552,766 | A | 9/1996 | Lee et al. |

(Continued)

FOREIGN PATENT DOCUMENTS

JP 08284528 A * 10/1996

OTHER PUBLICATIONS

Stanley Access Technologies, "MC521 Controller Installation and Operation Manual", Manual, Mar. 11, 2007, pp. 1-24, Rev. D, The Stanley Works, http://www.stanleyaccesstechnologies.com/downloads/204003D.pdf.

(Continued)

*Primary Examiner* — An T Nguyen

(74) *Attorney, Agent, or Firm* — Caeden C. Drayton; Adan Ayala; Ronald K. Aust

(57) ABSTRACT

An automatic door system includes a door controller having a plurality of door operation modes. A door driver mechanism is electrically coupled to the door controller, and operatively coupled to a door. A door system user interface is communicatively coupled to the door controller. The door system user interface has a processor unit configured to store a plurality of door operation schedules, with each door operation schedule having an execution date, an execution time, and a door operation mode of the plurality of door operation modes. The processor unit is configured to execute program instructions to: monitor a current date and time; select as an active operation schedule the door operation schedule having the execution date and the execution time that corresponds to the current date and the current time, and select at the door controller the door operation mode corresponding to that of the active operation schedule.

27 Claims, 11 Drawing Sheets

(56) References Cited

U.S. PATENT DOCUMENTS

| | | | | |
|---|---|---|---|---|
| 5,625,266 | A | 4/1997 | Stark | |
| 5,770,934 | A | 6/1998 | Theile | |
| 6,950,725 | B2 | 9/2005 | von Kannewurff et al. | |
| 6,967,565 | B2 | 11/2005 | Lingemann | |
| 7,019,614 | B2 | 3/2006 | Lavelle et al. | |
| 7,138,912 | B2 | 11/2006 | Fitzgibbon et al. | |
| 7,154,377 | B2 | 12/2006 | Gregori | |
| 7,181,369 | B2 * | 2/2007 | Kanki | G05B 23/0243 702/182 |
| 7,319,391 | B2 | 1/2008 | Lagarde et al. | |
| 7,468,676 | B2 * | 12/2008 | Styers et al. | 340/686.1 |
| 7,734,572 | B2 | 6/2010 | Wiemeyer et al. | |
| 2008/0016771 | A1 | 1/2008 | Marchetto | |
| 2009/0193717 | A1 | 8/2009 | Ebbe et al. | |
| 2009/0282740 | A1 | 11/2009 | Nassimi | |
| 2010/0063632 | A1 | 3/2010 | Tate | |
| 2010/0179850 | A1 * | 7/2010 | Fuller | G05B 15/02 705/7.12 |
| 2010/0241245 | A1 | 9/2010 | Wiemeyer et al. | |
| 2011/0060468 | A1 | 3/2011 | Roemer | |
| 2012/0023827 | A1 * | 2/2012 | Hancock | E05F 15/635 49/360 |
| 2013/0009785 | A1 * | 1/2013 | Finn | B61D 19/026 340/870.01 |
| 2014/0258497 | A1 * | 9/2014 | Kiyomasa et al. | 709/223 |

OTHER PUBLICATIONS

Stanley Access Technologies, "MC521 Pro Controller Installation and Operation Manual", Manual, Nov. 23, 2010, pp. 1-27, Rev. A, The Stanley Works.

* cited by examiner

48

| DOOR OPERATION SCHEDULES 52 | | | |
|---|---|---|---|
| SCHEDULE | EXECUTION DATE 54 | EXECUTION TIME 56 | DOOR OPERATION MODE 58 |
| 52-1 | M, T, W, TH, F | 9:00 AM | AUTOMATIC |
| 52-2 | M, T, W, TH, F | 10:00 PM | SAFE WHILE CLOSING |
| 52-3 | M, T, W, TH, F | 10:15 PM | CLOSED AND LOCK |
| ⋮ | ⋮ | ⋮ | ⋮ |

Fig. 4

48

| HOLIDAY DOOR OPERATION SCHEDULES 60 | | | |
|---|---|---|---|
| SCHEDULE | EXECUTION DATE 54 | EXECUTION TIME 56 | DOOR OPERATION MODE 58 |
| 60-1 | Nov 24 | 12:00 AM | CLOSED AND LOCKED |
| 60-2 | Nov 25 | 5:00 AM | AUTOMATIC |
| 60-3 | Nov 25 | 11:00 PM | CLOSED AND LOCKED |
| 60-4 | Nov 26 | 5:00 AM | AUTOMATIC |
| 60-5 | Nov 26 | 11:00 PM | CLOSED AND LOCKED |
| 60-6 | Jan 1 | 12:00 AM | CLOSED AND LOCKED |

Fig. 5

| SCROLL UP BUTTON 40 | | MENU BUTTON 36 | |
|---|---|---|---|
| INTERFACE MODE | FUNCTION | INTERFACE MODE | FUNCTION |
| STATUS MODE 64 | CHANGES THE USER INTERFACE MODE TO THE PREVIOUS MODE IN THE SET OF MODES | STATUS MODE 64 | ACCESSES THE MENU MODE |
| MENU MODE 66 | SCROLLS THROUGH AVAILABLE MENU ITEMS IN THE UP DIRECTION | MENU MODE 66 | EXITS FROM THE CURRENT MENU TO THE PREVIOUS MENU OR TO STATUS MODE |
| VALUE ADJUSTMENT MODE 68 | INCREASES VALUES | VALUE ADJUSTMENT MODE 68 | EXITS TO THE MENU MODE |

| SCROLL DOWN BUTTON 42 | | ENTER/SELECT BUTTON 38 | |
|---|---|---|---|
| INTERFACE MODE | FUNCTION | INTERFACE MODE | FUNCTION |
| STATUS MODE 64 | CHANGES THE USER INTERFACE MODE TO THE NEXT MODE IN THE SET OF MODES | STATUS MODE 64 | DISPLAYS MORE DETAILS ON THE CURRENT STATUS AND SELECTS THE NEXT SCREEN |
| MENU MODE 66 | SCROLLS THROUGH AVAILABLE MENU ITEMS IN THE DOWN DIRECTION | MENU MODE 66 | SELECTS THE CURRENT MENU ITEM |
| VALUE ADJUSTMENT MODE 68 | DECREASES VALUES | VALUE ADJUSTMENT MODE 68 | ENTERS THE CURRENT VALUE AND CONFIRMS VALUES/SETTINGS |

Fig. 6

AUTOMATIC DOOR SYSTEM WITH DOOR SYSTEM USER INTERFACE

CROSS-REFERENCE TO RELATED APPLICATIONS

None.

BACKGROUND OF THE INVENTION

1. Field of the Invention

The present invention relates to automatic door systems, and, more particularly, to a door system user interface for use in an automatic door system.

2. Description of the Related Art

Automatic door systems are in common use in commercial settings, such as for example, retail stores and warehouses. Typical of the types of doors on which automatic door systems are used, for example, include sliding doors, swinging doors, revolving doors, and overhead doors. The automatic door system typically includes a door controller, a door driver mechanism, and one or more sensors. The door driver mechanism typically includes a motor drivably coupled to a drive train, which in turn is drivably coupled to the door. The door controller is electrically coupled to the door driver motor and the sensors. The door controller is programmed to receive sensor information from the sensor, and control the door operation in accordance with the sensor information.

One such automatic door system includes a switch coupled to the controller to permit a user to manually select or override the automatic door functionality that is programmed into the door controller. For example, the door controller may be configured to operate in one of a plurality of operating modes. Such operating modes may include, for example, (a) an automatic mode wherein the door opens and closes automatically based on the sensor input, (b) a one-way (exit only) mode in which exterior sensors are disabled or ignored, (c) a hold open mode in which the door is opened and remains open, (d) a closed mode in which the door is commanded to close and remain closed. In operation, a user selects a switch position of the switch to select one of the operating modes.

What is needed in the art is a door system user interface that permits a user to schedule the operation of the automatic door system.

SUMMARY OF THE INVENTION

The present invention provides a door system user interface that permits a user to schedule the operation of an automatic door system.

The invention, in one form thereof, is directed to an automatic door system for operation of a door. A door controller is configured with a plurality of selectable door operation modes. A door driver mechanism is electrically coupled to the door controller, and operatively coupled to the door. The door driver mechanism includes a motor and a mechanical drive linkage configured to generate an electromotive force to operate the door. At least one sensor is electrically coupled to the door controller, each sensor being configured to detect a predetermined type of event and to provide a respective sensor signal to the door controller upon occurrence of a respective predetermined type of event. A door system user interface is communicatively coupled to the door controller. The door system user interface has an input panel and a display panel, and a processor unit electrically coupled to the input panel and the display panel. The processor unit includes a memory device configured to store a plurality of door operation schedules, with each door operation schedule having an execution date, an execution time, and a predetermined door operation mode of the plurality of selectable door operation modes. The processor unit is configured to execute program instructions to: monitor a current date and current time, select as an active operation schedule the door operation schedule of the plurality of door operation schedules having the execution date and the execution time that corresponds to the current date and the current time, and select at the door controller the door operation mode corresponding to the predetermined door operation mode of the active operation schedule.

The invention, in another form thereof, is directed to a door system user interface configured for communication with a door controller of an automatic door system. The door controller is a programmable device configured with a plurality of selectable door operation modes associated with operation of a door. The door system user interface includes an input panel configured to receive user input, a display panel configured to display information associated with the automatic door system, and a processor unit communicatively coupled to the input panel and to the display panel. The processor unit includes a microprocessor system, an electronic memory device, and an Input/Output module. The electronic memory device has stored therein a plurality of door operation schedules, with each door operation schedule having an execution date, an execution time, and a predetermined door operation mode of the plurality of selectable door operation modes. The processor unit is configured to execute program instructions to: monitor a current date and current time, select from the electronic memory device as an active operation schedule the door operation schedule of the plurality of door operation schedules having the execution date and the execution time that corresponds to the current date and the current time, and send a signal from the Input/Output module to the door controller to select at the door controller the door operation mode corresponding to the predetermined door operation mode of the active operation schedule.

The invention, in another form thereof, is directed to a method for automatically selecting a door operation mode of a plurality of selectable door operation modes at a door controller of an automatic door system. The method includes providing a door system user interface in communication with the door controller; providing a plurality of door operation schedules stored in the door system user interface, with each door operation schedule having an execution date, an execution time, and a predetermined door operation mode of the plurality of selectable door operation modes; monitoring a current date and current time; selecting as an active operation schedule the door operation schedule of the plurality of door operation schedules having the execution date and the execution time that corresponds to the current date and the current time; and sending a signal from the door system user interface to the door controller to select at the door controller the door operation mode corresponding to the predetermined door operation mode of the active operation schedule.

Further aspects of the invention may include displaying on the door system user interface a current door status, and/or displaying and storing on the door system user interface door errors identified by the door controller.

BRIEF DESCRIPTION OF THE DRAWINGS

The above-mentioned and other features and/or advantages of this invention, and the manner of attaining them, will become more apparent and the invention will be better understood by reference to the following description of an embodiment of the invention taken in conjunction with the accompanying drawings, wherein:

FIG. 4 depicts a plurality of exemplary door operation schedules stored in a memory device of the door system user interface depicted in FIG. 3;

FIG. 5 depicts exemplary holiday door operation schedules stored in the memory device of the door system user interface depicted in FIG. 3;

FIG. 6 is a block diagram that correlates the functionality of the various buttons of the door system user interface depicted in FIG. 2 with the interface modes available in the door system user interface.

Corresponding reference characters indicate corresponding parts throughout the several views. The exemplifications set out herein illustrate an embodiment of the invention, and such exemplifications are not to be construed as limiting the scope of the invention in any manner.

DETAILED DESCRIPTION OF THE INVENTION

Figure 1:
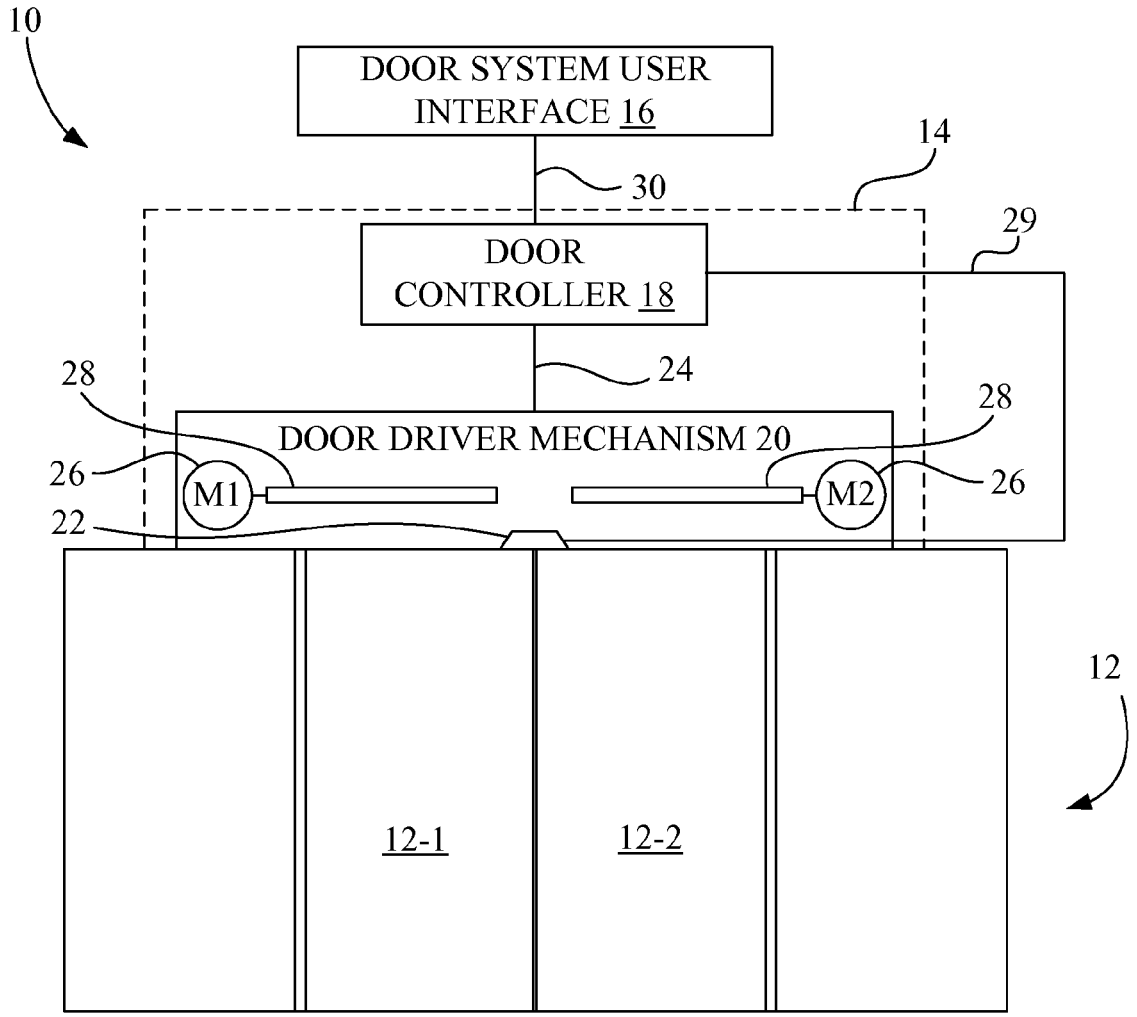
FIG. 1 is a block diagram of an automatic door system embodying the present invention.

Referring now to the drawings and particularly to FIG. 1, there is shown an exemplary embodiment of an automatic door system 10. Automatic door system 10 includes a door 12, a door controller system 14, and a door system user interface 16.

In the present embodiment, door 12 is depicted as a dual horizontal sliding door, having two sliding door panels 12-1 and 12-2. However, it is to be understood that the present invention may be adapted for use with other types of doors, such as for example, a swinging door, a revolving door or an overhead vertical sliding door.

Door controller system 14 may include, for example, a door controller 18, a door driver mechanism 20, and at least one sensor 22.

Door controller 18 is a commercially available programmable device configured with a plurality of door operation modes. Door controller 18 may be, for example, an MC521 door controller commercially available from Stanley Black & Decker. Exemplary door operation modes suitable for use with door controller 18 are set forth in Table 1, below.

TABLE 1

| Door Operation Modes | |
|---|---|
| Door Operation Mode | Functional Description |
| AUTOMATIC | Door 12 opens and closes automatically based on a sensor output from the at least one sensor 22. |
| REDUCED AUTOMATIC | Door 12 is only partially opened during automatic operation. |
| HOLD OPEN | Door 12 is opened and remains open. |

TABLE 1-continued

| Door Operation Modes | |
|---|---|
| Door Operation Mode | Functional Description |
| ONE-WAY | Door 12 is operable for one of ingress or egress, but not the other of egress or ingress. May be used, for example, as an Exit Only mode. |
| REDUCED ONE-WAY | Door 12 is only partially opened during one-way operation for ingress or egress. |
| SAFE-WHILE-CLOSING | Door controller 18 operates in a prior door operation mode with regards to sensor outputs from sensor 22 until the door 12 is closed, and when the door 12 is closed the door 12 remains closed. |
| CLOSE | Door 12 is closed without regard to senor outputs and remains closed. |
| CLOSED AND LOCKED | Door 12 is closed without regard to senor outputs and is then locked. |

The "hold open" mode includes as variations a "temporary hold open" mode and a "permanent hold open" mode. In the "temporary hold open" mode", door controller 18 maintains the door 12 in an open condition for a predetermined limited amount of time, and then door 12 closes. In the "permanent hold open" mode, door controller 18 maintains the door 12 in an open condition until another door operation mode, such as "automatic" or "close", is selected.

Door driver mechanism 20 is electrically coupled to door controller 18 via a multi-conductor cable 24. Multi-conductor cable 24 may include individual conductors that function, for example, to supply control signals from door controller 18 to door driver mechanism 20, to provide monitoring signals from door driver mechanism 20 to door controller 18, and/or to provide electrical power to door driver mechanism 20. Door driver mechanism 20 is operatively coupled to door 12. Door driver mechanism 20 is configured to generate an electromotive force to operate the door 12, and includes at least one motor 26 (two motors M1 and M2 are shown) and a respective mechanical drive linkage 28 that is drivably connected to door 12. Motor 26 may be, for example, an AC or DC rotary motor, a stepper motor, or a linear motor. Mechanical drive linkage 28 may be, for example, a pulley/belt drive, a gear/chain drive, or a gear train drive.

Each sensor 22 is electrically coupled, e.g., by a wired connection 29, to door controller 18. Each sensor 22 is configured to provide detection of a predetermined type of event and to provide a respective sensor signal to door controller 18 upon occurrence of a respective predetermined type of event. For example, one type of sensor 22 may be a motion (e.g., infrared) sensor that detects an event of an approaching person. Other types of suitable sensors may be, for example, a pressure switch, a capacitive coupled switch, an electromechanical micro-switch, etc.

In accordance with the present invention, door system user interface 16 is communicatively coupled to door controller 18 by a communications link 30. Communications link 30 may be, for example, a serial communications link, such as for example, a wired RS-232 serial link, a wired RS-485 serial link, a wired USB serial link, etc. Alternatively, it is contemplated that the system may be modified such that communications link 30 accommodates wireless communication.

Figure 2:
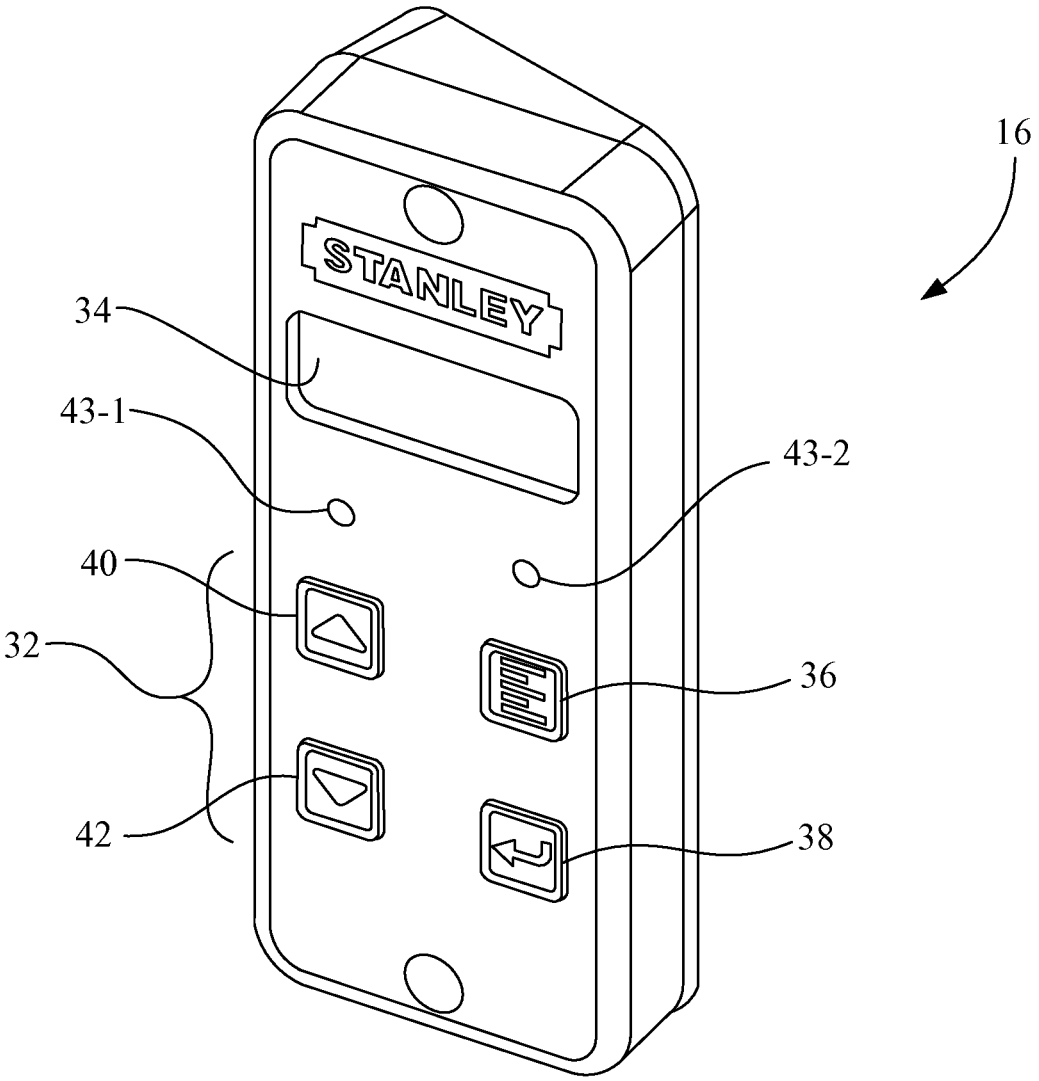
FIG. 2 is a perspective view of a door system user interface of the automatic door system of FIG. 1 that is configured in accordance with an embodiment of the present invention.

Referring to FIG. 2, door system user interface 16 has an input panel 32 and a display panel 34. Input panel 32 may include one or more pushbuttons, such as for example, a menu button 36, an enter/select button 38, a scroll up button 40 and a scroll down button 42. Display panel 34 may be, for example, a liquid crystal display (LCD). Door system user interface 16 further includes a pair of indicator lights, e.g., LEDs, 43-1 and 43-2, which respectively may signify an input error or successful input entry.

Figure 3:
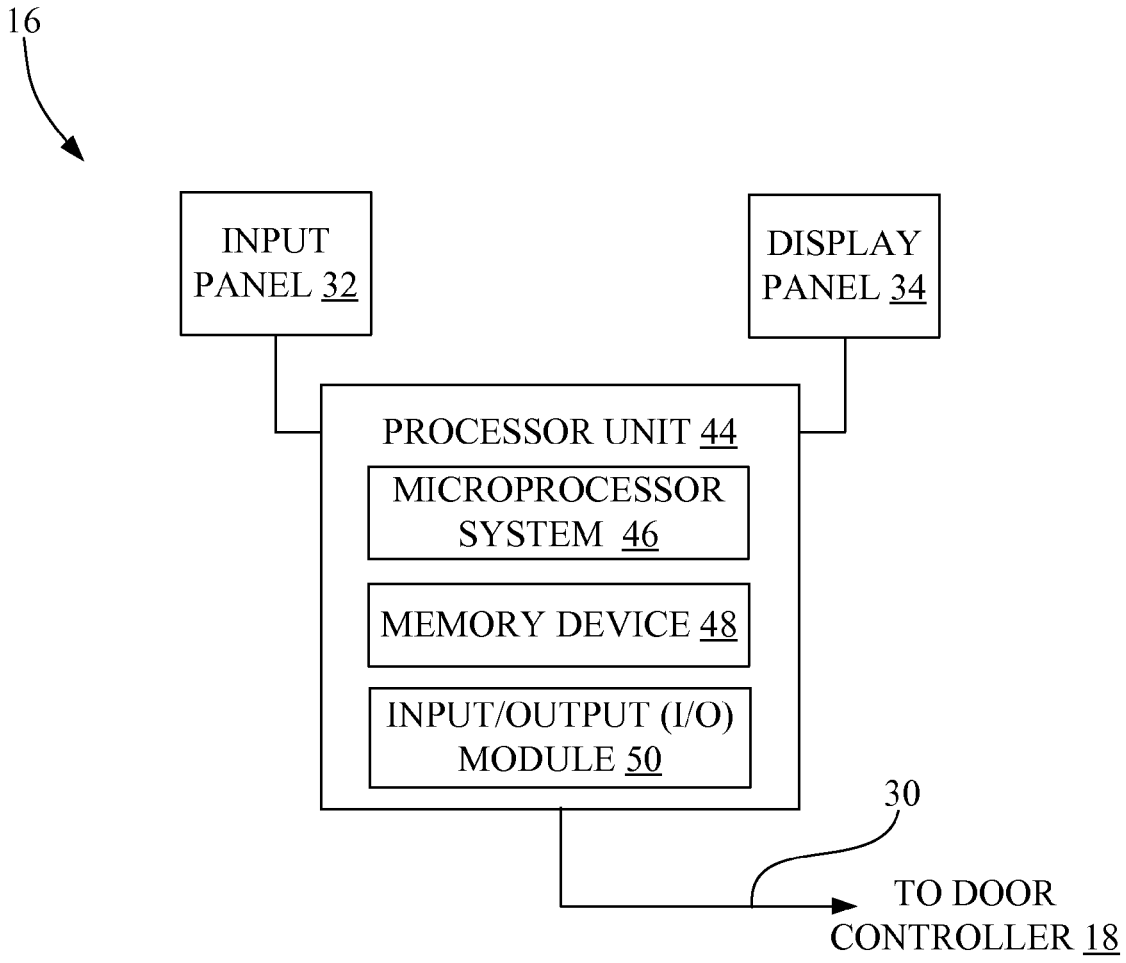
FIG. 3 is a block diagram of the door system user interface of FIG. 2.

Referring also to FIG. 3, door system user interface 16 includes a processor unit 44 electrically and communicatively coupled to the input panel 32 and to display panel 34. Processor unit 44 may include, for example, a microprocessor system 46 and an electronic memory device 48. A typical microprocessor system 46 includes a microprocessor and associated resident electronic memory, and associated input/output devices, as is known in the art. Such a microprocessor system 46 may be based on a commercially available microcontroller, such as for example, a STM32F101R8T6 microcontroller available from STMicroelectronics having headquarters in Coppell, Tex. Memory device 48 is communicatively coupled to microprocessor system 46, and is a physical electronic memory device configured to electronically store information, such as for example, a plurality of door operation schedules, information associated with door error events, etc. Memory device 48 may include both a temporary memory, e.g., random access memory (RAM) and a semi-permanent memory, e.g., an electrically erasable programmable read only memory (EEPROM). Alternatively, memory device 48 may be incorporated into the resident electronic memory of microprocessor system 46.

Door system user interface 16 further includes an Input/Output (I/O) module 50 configured to facilitate bi-directional communications with door controller 18. For example, I/O module 50 may be configured as a serial RS-232, a serial RS-485, or USB communications interface, which is connected to communications link 30. Thus, signals may be sent by door system user interface 16 to door controller 18 via I/O module 50. Also, signals may be received by door system user interface 16 from door controller 18 via I/O module 50.

Depicted in FIG. 4 is an exemplary series of door operation schedules 52, including a door operation schedule 52-1, a door operation schedule 52-2, and a door operation schedule 52-3, that may be individually selected by door system user interface 16. Each door operation schedule of a plurality of door operation schedules 52 (individually identified as a respective door operation schedule 52-1, 52-2, 52-3, . . . ) includes multiple pieces of stored information, such as for example, an execution date 54, an execution time 56, and a predetermined door operation mode 58 of a plurality of selectable door operation modes, such as one of the selectable door operation modes set forth above in Table 1. Processor unit 44 is configured to execute program instructions, which may be stored for example in memory device 48, to: monitor a current date and current time; select from memory device 48 as an active operation schedule the door operation schedule 52-1, 52-2, 52-3, . . . of the plurality of door operation schedules 52 that has the execution date 54 and the execution time 56 that corresponds to the current date and the current time; and select at door controller 18 the door operation mode corresponding to the predetermined door operation mode 58 of the active operation schedule.

The active operation schedule is changed to a next door operation schedule of the plurality of door operation schedules 52 when a next execution date 54 and a next execution time 56 of the next door operation schedule corresponds to the current date and the current time. The execution date 54 and the current date may be represented, for example, as a day in a seven day weekly cycle of Sunday (S), Monday (M), Tuesday (T), Wednesday (W), Thursday (Th), Friday (F), and Saturday (Sa). Alternatively, the execution date 54 may be a day in a one month cycle, e.g., a particular numbered day of the month, e.g., day 15 of a 30 day month, or a month/day of a calendar year, e.g., September 21. The execution time 56 and current time may be established in a 12 hour format or a 24 hour format.

As an example, when the current date corresponds to the execution date 54 of the days of Monday (M), Tuesday (T), Wednesday (W), Thursday (Th), or Friday (F), and when the current time corresponds to the execution time 56 of 9:00 a.m., then door operation schedule 52-1 becomes the active operation schedule, and the door operation mode 58 of "automatic" is selected at door controller 18 by door system user interface 16 via communications link 30 (see also Table 1 above). Door controller 18 will continue operating in the "automatic" mode until a change to a different door operation schedule in the door operation schedules 52. For example, based on door operation schedule 52-2, when the current date corresponds to the execution date 54 of the days of Monday (M), Tuesday (T), Wednesday (W), Thursday (Th), or Friday (F), and when the current time corresponds to the execution time 56 of 10:00 p.m., then door operation schedule 52-2 is selected as the active operation schedule, and the door operation mode 58 is changed from "automatic" to "safe-while-closing" at door controller 18 by door system user interface 16 via communications link 30. Thus, a time of duration of a door operation schedule, e.g., door operation schedule 52-1, may be less than 24 hours based on an execution date and execution time of a next door operation schedule, e.g., door operation schedule 52-2.

Thereafter, based on door operation schedule 52-3, when the current date corresponds to the execution date 54 of the days of Monday (M), Tuesday (T), Wednesday (W), Thursday (Th), or Friday (F), and when the current time corresponds to the execution time 56 of 10:15 p.m., then door operation schedule 52-3 is selected as the active schedule, and the door operation mode 58 is changed from "safe-while-closing" to "closed and locked" at door controller 18 by door system user interface 16 via communications link 30.

It should be noted that after Friday (F), door controller 18 will remain in the "closed and locked" mode of door operation schedule 52-3 is maintained over the period including Saturday (Sa) and Sunday (S), until 9:00 a.m. on the following Monday (M), when door operation schedule 52-1 is selected by door system user interface 16 to select the door operation mode 58 of "automatic" at door controller 18 via communications link 30. Thus, a time of duration of a door operation schedule, e.g., door operation schedule 52-3, may be in some instances greater than 24 hours based on an execution date and execution time of the next door operation schedule, e.g., door operation schedule 52-1.

The schedule sequence described above is by way of example only, and in actual practice may include additional intervening, beginning or ending door operation schedules, that include additional door operation modes, such as those in Table 1 above.

Referring to FIG. 5, as a further feature of door system user interface 16, memory device 48 is configured to store a group of door operation schedules 60 that correspond to a predetermined time period, such as for example Holiday Door Operation Schedules 60. It should be appreciated that, due to variations of store operation hours during such a holiday period, it is convenient for the user of door system user interface 16 to simply select Holiday Door Operation Schedules 60, rather than to individually modify the contents of an exiting schedule to accommodate a holiday, and then again modify the door operation schedules following the holiday period to return to normal store hours.

During execution of Holiday Door Operation Schedules 60, processor unit 44 is configured to execute program instructions to select one door operation schedule 60-1, 60-2, 60-3, 60-4, 60-5 and 60-6 of the group of door operation schedules during the predetermined time period, e.g., corresponding to Holiday Door Operation Schedules 60, based on the execution date 54 and the execution time 56 of each door operation schedule 60-1, 60-2, 60-3, 60-3, 60-4, 60-5, and 60-6 of the group of door operation schedules 60.

For example, a retail store may be closed for the entirety of the day on the holiday of Thanksgiving Day in the United States of America. However, the Friday after Thanksgiving Day may have special extended shopping hours, followed by additional shopping hours on Saturday and Sunday having store hours that differ from the normal Monday through Friday store hours. Such a schedule might be as follows.

As an example, when the current date corresponds to the execution date 54 of the date of November 24, and when the current time corresponds to the execution time 56 of 12:00 a.m., then door operation schedule 60-1 is selected, and the door operation mode 58 is changed from "automatic" to "Closed and Locked" at door controller 18 by door system user interface 16 via communications link 30. (See also Table 1, above). Thereafter, since there are no additional entries in Holiday Door Operation Schedules 60 for the date of November 24, the door operation mode shall not be changed again nor will any schedules from Door Operation Schedules 58 be used. (Existence of a date in schedule 60 precludes the use of any matching schedule from Door Operation Schedules 58 during that date, only holiday (date specific) schedules will be used). Due to operation schedule 60-2, when the current date corresponds to the execution date 54 of the date of November 25, and when the current time corresponds to the execution time 56 of 5:00 a.m., the door operation mode 58 is changed from "closed and locked" to "automatic" at door controller 18 by door system user interface 16 via communications link 30.

During Holiday Door Operation Schedules 60, controller 18 will remain in the "automatic" mode over the period from November 25 at 5:00 a.m. through November 25 at 11:00 p.m., when door operation schedule 60-3 is selected by door system user interface 16 to select the door operation mode 58 of "closed and locked" at door controller 18 via communications link 30. Door operation schedules 60-4 and 60-5 are basically copies of the functionality on the following day.

During Holiday Door Operation Schedules 60, for the date of January 1 and January 2 (assumed to not be a holiday), with reference to door operation schedule 60-6, when the current date corresponds to the execution date 54 of the date of January 1, and when the current time corresponds to the execution time 56 of 12:00 a.m., the door operation mode 58 of "closed and locked" is selected at door controller 18 by door system user interface 16 via communications link 30. Door controller 18 will continue operating in the "closed and locked" mode until door system user interface 16 changes the door operation mode to a mode determined by the normal door operation schedule 52, such as 52-1 (in the event that January 2 is a M, T, W, TH, or F) at 9:00 a.m. when the "automatic" mode is selected, at door controller 18 by door system user interface 16 via communications link 30.

A holiday time period is defined by the existence of the date in schedule 60. It includes the entire date from 12:00 a.m. to 11:59 p.m. on that date. During this holiday time only schedules from schedule 60 shall be used, schedules found in schedule 52 are ignored. When a holiday time period is not active, processor unit 44 of door system user interface 16 will automatically revert back to a normal door operation sequence, such as that illustrated in FIG. 4.

Door system user interface 16 is configured to facilitate the initial entry, or the editing/modification, of the door operation schedules 52, 60. For example, input panel 32 of the door system user interface 16 includes at least one input button configured to receive user input to request modification of a respective door operation schedule. Processor unit 44 is configured to receive the user input from input panel 32 and execute program instructions to select a desired date, a desired time and a desired door operation mode to be associated with a respective door operation schedule to be entered, or subsequently modified.

Door system user interface 16 is further configured to retrieve from door controller 18 and display the current status of door controller 18/door 12. Thus, door system user interface 16 may report via display panel 34 the current status of door controller 18/door 12 in real time, and allows the user to obtain normal operating conditions such as the cumulative cycle count for the automatic door system 10. In addition, door user interface 16 may be configured to retrieve from door controller 18 and display information associated with the door errors that are identified by door controller 18.

For example, processor unit 44 of door system user interface 16 may be configured to poll door controller 18 in real time for the occurrence of the door errors, in which processor unit 44 of the door system user interface 16 is configured to receive a current door error from door controller 18 via communications link 30, and display the current door error on display panel 34 of door system user interface. Such a door error may be, for example, an error of "failure to close" when operating in the "automatic" door operation mode (see Table 1, above).

Also, processor unit 44 of door system user interface 16 is configured to poll the door controller 18 via communications link 30 to log information associated with the door errors identified by door controller 18. For example, memory device 48 of door system user interface 16 may include a set of information storage locations established as an event log. The event log provides locations for storing a record of errors and/or warnings that exist in automatic door system 10, and each set of door error information may include, for example, a date and time stamp to allow service persons to understand when and how often particular errors have occurred.

Input panel 32 of door system user interface 16 includes at least one input button configured to receive a user input requesting retrieval of information from the event log stored in memory device 48. Processor unit 44 is configured to receive the user input from input panel 32, and execute program instructions to retrieve at least a portion of the event log from memory device 48 for display on display panel 34 of door system user interface 16. For example, due to size limitations of display panel 34, it may be possible to display information from only two door error events from the event log at one time on display panel 34.

With respect to a door error, door system user interface 16 may report via display panel 34 specific items such as the installation date and last service date of the automatic door system 10, and may also report via display panel 34 a service contact telephone number or other contact information.

Referring to FIGS. 2 and 6, the functionality of door system user interface 16 will be described in more detail with respect to menu button 36, enter/select button 38, scroll up button 40 and scroll down button 42 of input panel 32. Door system user interface 16 is configured, via executable programming stored in memory device 48 and executed by processor unit 44, to operate in a selected one of a set of three different user interface modes, namely: a Status Mode 64, a Menu Mode 66, and a Value Adjustment Mode 68. In the present embodiment, Status Mode 64 is the default mode.

As a safety feature, door system user interface 16 may be configured to require entry of an authorization code, or pin number, to enable schedule modifications, including door operation mode changes, thus making a portion of the menus and the value adjustments lockable. For example, the authorization code may be in the form of a unique key sequence of two or more of menu button 36, enter/select button 38, scroll up button 40 and/or a scroll down button 42, with the correct sequence being required in order for a user to access Value Adjustment Mode 68.

As set forth in the charts of FIG. 6, when door system user interface 16 is operating in Status Mode 64, pressing scroll up button 40 changes the user interface mode to the previous mode in the set of modes. When door system user interface 16 is operating in Status Mode 64, pressing scroll down button 42 changes the user interface mode to the next user interface mode in the set of modes. When door system user interface 16 is in Status Mode 64, pressing menu button 36 accesses Menu Mode 66. When door system user interface 16 is operating in Status Mode 64, pressing enter/select button 38 displays more details on the current status and selects the next screen on display panel 34.

When door system user interface 16 is operating in Menu Mode 66, pressing scroll up button 40 scrolls through available menu items in the up direction. When door system user interface 16 is operating in Menu Mode 66, pressing scroll down button 42 scrolls through available menu items in the down direction. When door system user interface 16 is in Menu Mode 66, pressing menu button 36 exits from the current menu and returns to the previous menu, or if there is no previous menu, then the door system user interface 16 exits the Menu Mode 66 and returns to the Status Mode 64. When door system user interface 16 is in Menu Mode 66, pressing enter/select button 38 selects the current menu item, and a sub-screen associated with the menu item may be displayed on display panel 34.

When door system user interface 16 is operating in Value Adjustment Mode 68, pressing scroll up button 40 increases values. When door system user interface 16 is operating in Value Adjustment Mode 68, pressing scroll down button 42 decreases values. When door system user interface 16 is in Value Adjustment Mode 68, pressing menu button 36 exits from the Value Adjustment Mode 68 to enter Menu Mode 66. When door system user interface 16 is in Value Adjustment Mode 68, pressing enter/select button 38 enters the current value and confirms values/settings.

FIGS. 7A-7G depict a plurality of exemplary screens associated with a main menu 70 available for display on display panel 34 of door system user interface 16.

Figure 7A:
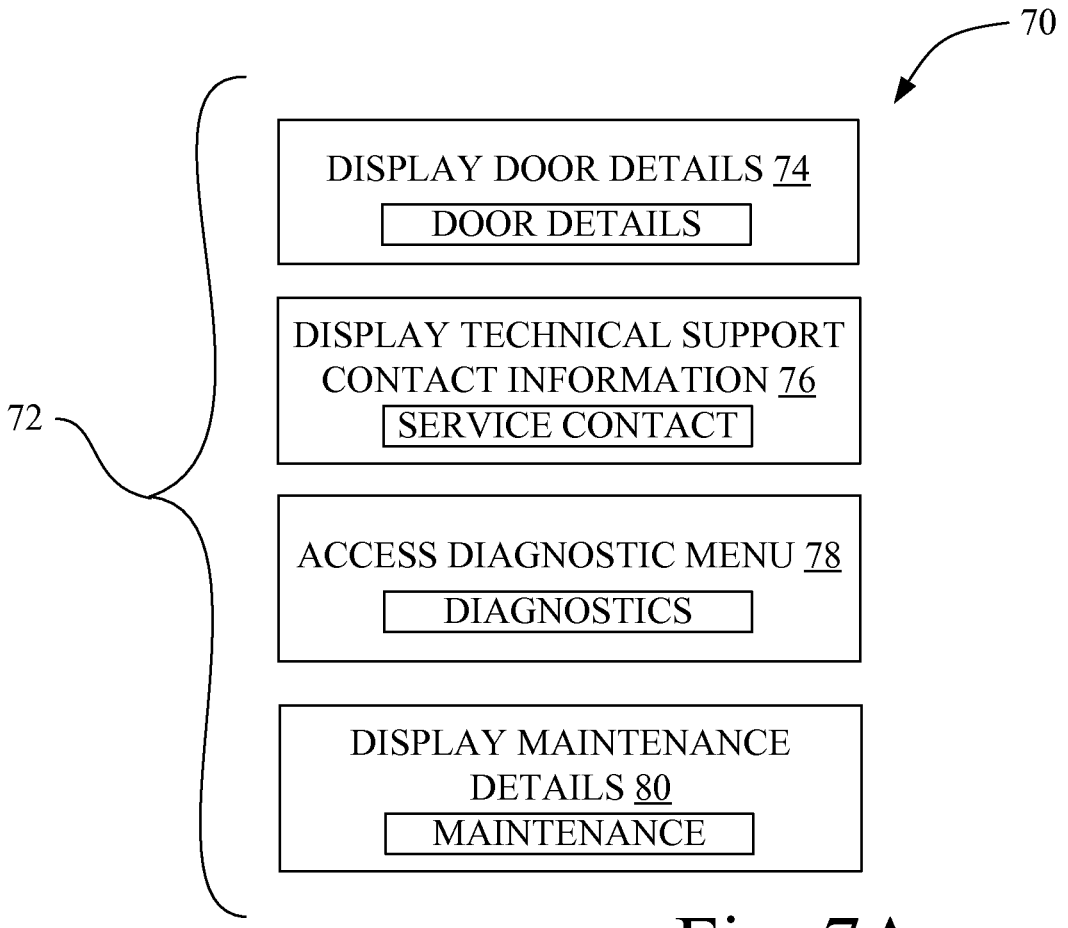
FIGS. 7A-7G depict a plurality of exemplary screens associated with a main menu available for display on the display panel of the door system user interface.
Figure 7B:
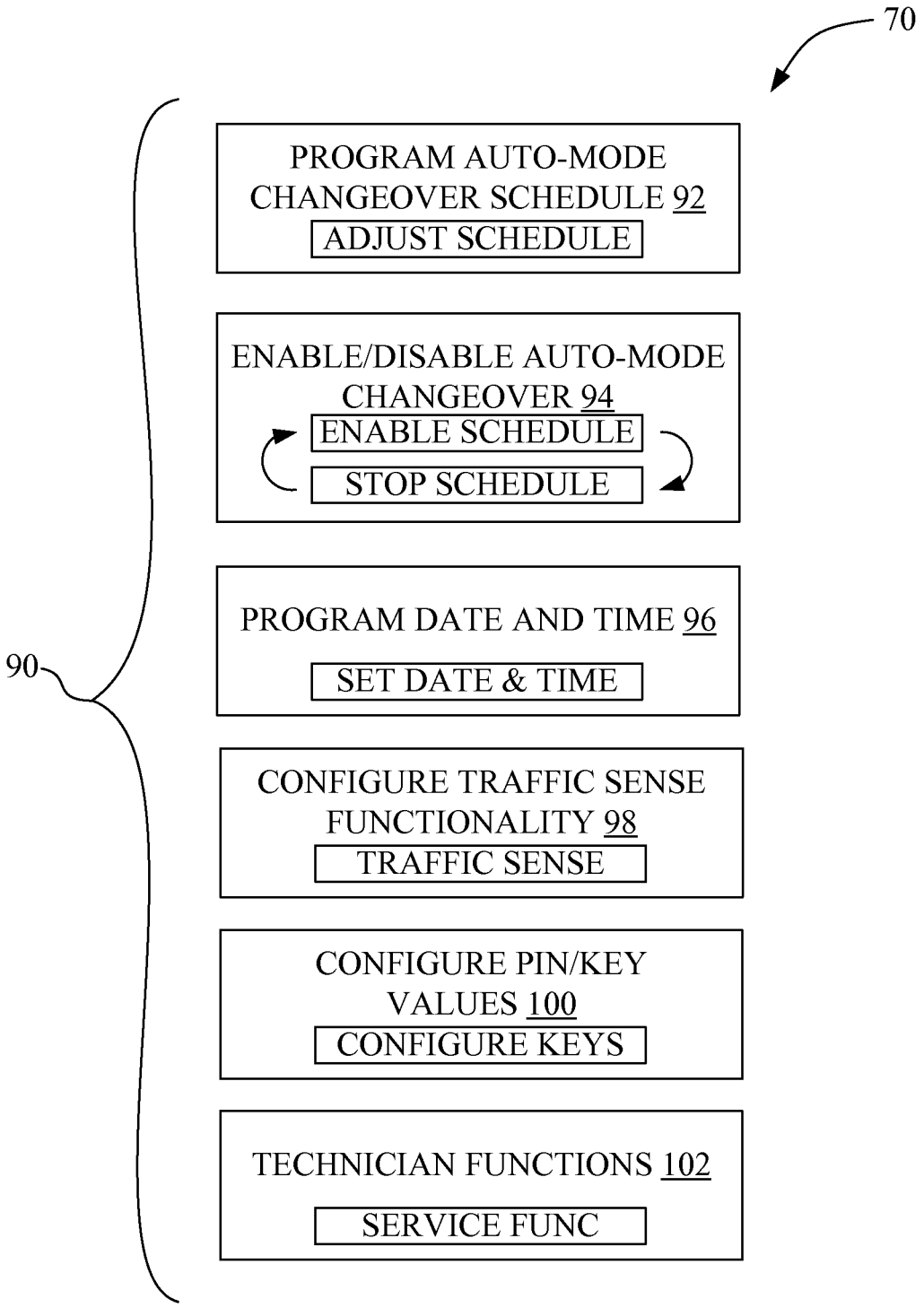

In FIGS. 7A and 7B, represent a set of screens for main menu 70 for display by display panel 34, with those menu screens 72 shown in FIG. 7A being freely accessible, and with those menu screens 90 shown in FIG. 7B requiring special authorization to enable making a selection from the screen. Scroll up button 40 and scroll down button 42 may be used to scroll between the screens within the main menu 70 depicted in FIGS. 7A and 7B when in the menu mode 66.

Referring now to FIG. 7A, the freely accessible main menu screens 72 of main menu 70 may include for example: a Display Door Details Screen 74, a Display Technical Support Contact Information Screen 76, an Access Diagnostic Menu Screen 78, and a Display Maintenance Details Screen 80.

Display Door Details Screen 74 provides the "Door Details" option, and various information regarding the door 12. For example, the door identification number and the number of door cycles, may be displayed on display panel 34 by manipulating one of the scroll up button 40 or scroll down button 42.

Display Technical Support Contact Information Screen 76 provides the "Service Contact" option, and various contact information, e.g., a phone number, for a service contact for automatic door system 10 may be displayed on display panel 34 by manipulating one of the scroll up button 40 or scroll down button 42.

Figure 7C:
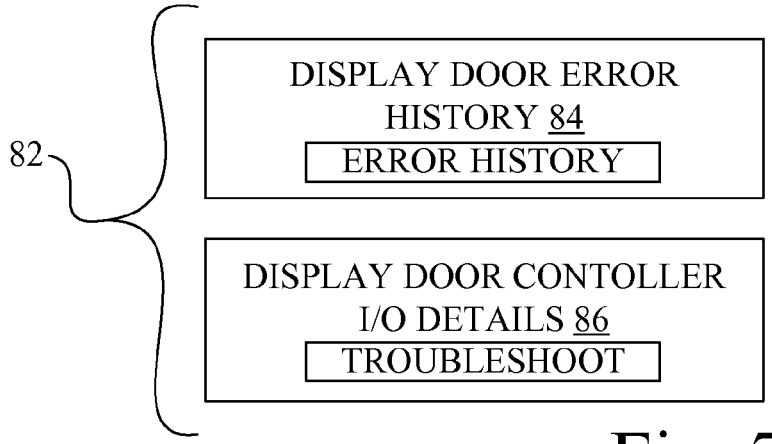

Access Diagnostic Menu Screen 78 provides the "Diagnostics" option, and in turn provides access to a Diagnostic Menu 82 depicted in FIG. 7C by pressing enter/select button 38.

In FIG. 7C, the user may scroll between a Display Door Error History Screen 84 and a Display Door Controller I/O Details Screen 86. When the Display Door Error History Screen 84 is selected by pressing enter/select button 38, then the error log maintained in memory device 48 is displayed on display panel 34. The error log may display the number of error occurrences, and the last occurrence cycle, as well as the age of the error log (e.g., time since last boot-up). Various portions of the error log may be displayed on display panel 34 by manipulating one of the scroll up button 40 or scroll down button 42. When the Display Door Controller I/O Details Screen 86 is selected by pressing enter/select button 38, then two screens may display the current active sensors or the last sensor activation, and the two screens may be alternately displayed on display panel 34 by manipulating one of the scroll up button 40 or scroll down button 42.

Referring again to FIG. 7A, the Display Maintenance Details Screen 80 provides the "Maintenance" option, with the ability to review maintenance records on display panel 34 by manipulating one of the scroll up button 40 or scroll down button 42. For example, based on a door cycle count, a customer may be advised of the expected lifetime of door 12 and the remaining cycles of various components, such as for example, the remaining cycles for motor 26 and mechanical drive linkage 28 of door driver mechanism 20. Also accessible is the automatic door system 10 install date and service dates.

Referring now to FIG. 7B, menu screens 90 requiring special authorization to enable making a selection from the screen may include, for example: a Program Auto-Mode Changeover Schedule Screen 92; an Enable/Disable Auto-Mode Changeover Screen 94, a Program Date And Time Screen 96, a Configure Traffic Sense Functionality Screen 98, a Configure Pin/Key Values Screen 100, and a Technician Functions Screen 102.

Figure 7D:
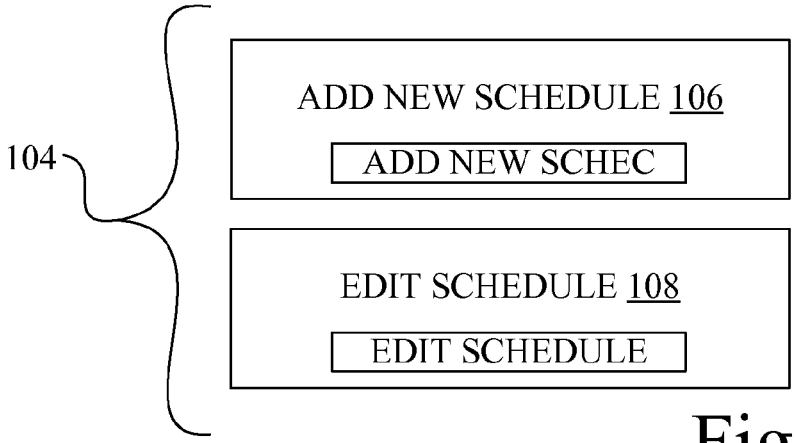

Program Auto-Mode Changeover Schedule Screen 92 provides the option of "Adjust Schedule", upon pressing enter/select button 38, proceeds to the Schedule Menu 104 depicted in FIG. 7D. By using the scroll up button 40 or the scroll down button 42, display panel 34 toggles between an Add New Schedule Screen 106 and an Edit Schedule Screen 108. The Add New Schedule Screen 106 provides the "Add New Schedule" option, and one or more new door operation schedules may be generated and stored in memory device 48. The Edit Schedule Screen 108 provides the "Edit Schedule" option, and an existing door operation schedule previously stored in memory device 48 may be edited, and those changes stored in memory device 48.

Referring again to FIG. 7B, Enable/Disable Auto-Mode Changeover Screen 94 provides the "Enable Schedule" or "Stop Schedule" options. By using the scroll up button 40 or the scroll down button 42, display panel 34 toggles between Enable Schedule or Stop Schedule. If it is desired to select one of the options, then the enter/select button 38 is pressed when the desired option is displayed.

Program Date And Time Screen 96 provides the "Set Date & Time" option, and the current date and the current time may the displayed on display panel 34 and changed by manipulating one of the scroll up button 40 or scroll down button 42.

Configure Traffic Sense Functionality Screen 98 provides the "Traffic Sense" option, and when enabled, displays the current traffic sense setting, such as for example, one of Off, Low, Medium, High at display panel 34. A selection of one of Off, Low, Medium, High may be made by using the scroll up button 40 or the scroll down button 42 to scroll through the options, and then pressing the enter/select button 38.

Figure 7E:
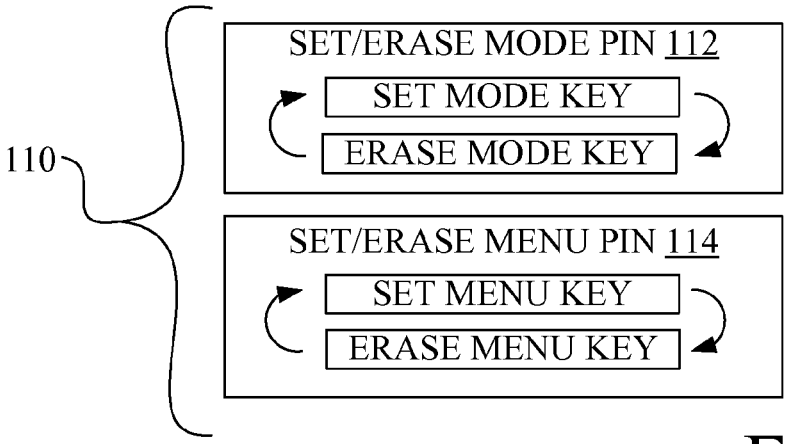

Configure Pin/Key Values Screen 100 provides the "Configure Keys" option, and upon pressing enter/select button 38, proceeds to the Configure Pins Menu 110 depicted in FIG. 7E. By using the scroll up button 40 or the scroll down button 42, display panel 34 toggles between a Set/Erase Mode Pin Screen 112 and a Set/Erase Menu Pin Screen 114. In the Set/Erase Mode Pin Screen 112, an option of setting or erasing the mode key is provided by using the scroll up button 40 or the scroll down button 42. In the Set/Erase Menu Pin Screen 114, an option of setting or erasing the menu key is provided by using the scroll up button 40 or the scroll down button 42.

Figure 7F:
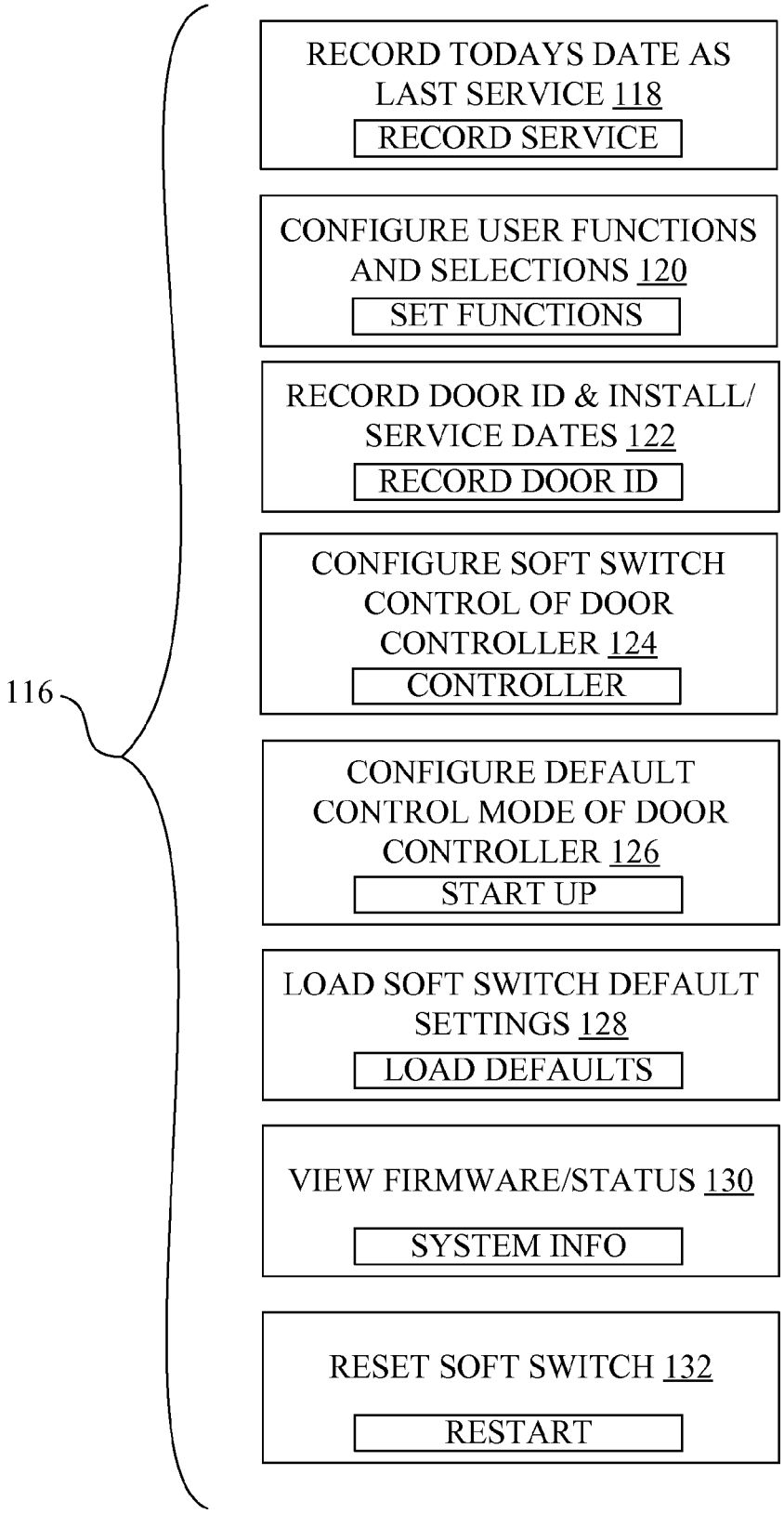

Referring again to FIG. 7B, the Technician Functions Screen 102 provides the "Service Function" option, which in turn, when selected, provides access to a plurality of Service Menu Screens 116 depicted in FIG. 7F. The Service Menu Screens 116 may include, for example, a Record Today's Date As Last Service Screen 118, a Configure User Functions And Selections Screen 120, a Record Door ID & Install/Service Dates Screen 122, a Configure Soft Switch Control Of Door Controller Screen 124, a Configure Default Control Mode Of Door Controller Screen 126, a Load Soft Switch Default Settings Screen 128, a View Firmware/Status Screen 130, and a Reset Soft Switch Screen 132.

The Record Today's Date As Last Service Screen 118 provides the "Record Service" option to record the date of service of automatic door system 10.

Figure 7G:
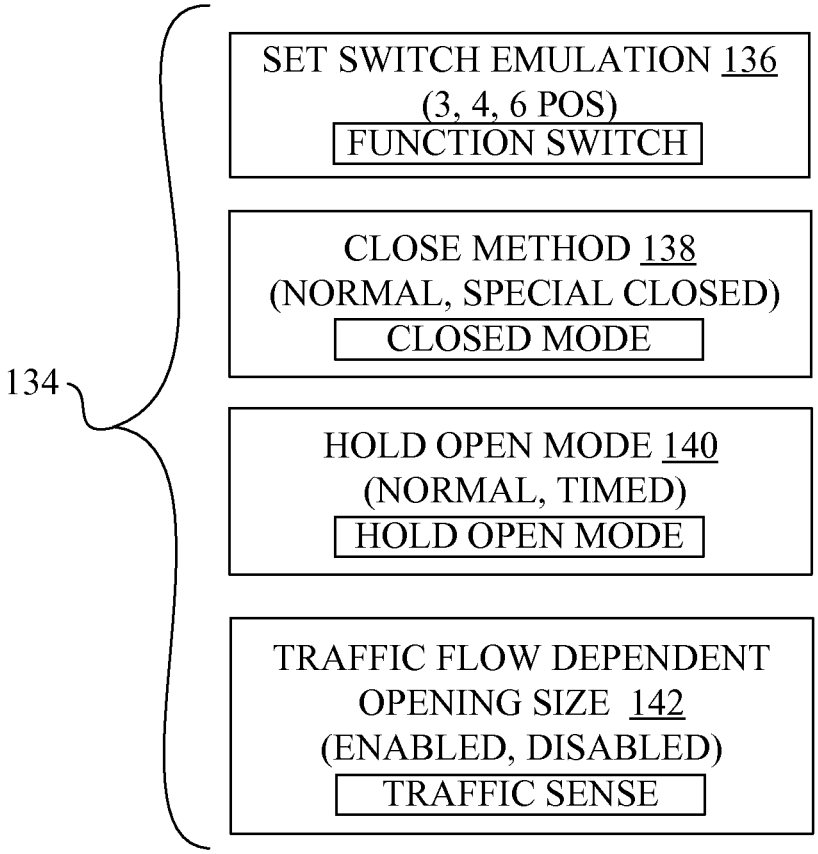

The Configure User Functions And Selections Screen 120 provides the "Set Functions" option, to facilitate access to the Function Configuration Menu Screens 134 depicted in FIG. 7G. The Function Configuration Menu Screens 134 may include a Set Switch Emulation Screen 136, a Close Method Screen 138, a Hold Open Mode Screen 140, and a Traffic Flow Dependent Opening Size Screen 142.

The Set Switch Emulation Screen 136 provides the "Function Switch" option of setting a function switch to a desired level. The Close Method Screen 138 provides the "Closed Mode" option, such as selection between a normal closed mode, or a special closed mode. The Hold Open Mode Screen 140 provides the "Hold Open Mode" option, for example, for a selection of one of a normal (e.g., permanent) or timed Hold Open Mode. Traffic Flow Dependent Opening Size Screen 142 provides the "Traffic Sense" option, of either enabled or disabled.

Referring again to FIG. 7F, Record Door ID & Install/Service Dates Screen 122 provides the "Record Door ID" option, wherein the current date and current time are saved as the install date and time.

The Configure Soft Switch Control Of Door Controller Screen 124 provides the "Controller" option, which is the ability to select at the door controller 18 the type of input device, e.g., hardware, such as rocker switches, or software/firmware, such as the door system user interface 16.

The Configure Default Control Mode Of Door Controller Screen 126 provides the "Start Up" option, such as a particular start up mode for automatic door system 10.

Load Soft Switch Default Settings Screen 128 provides the "Load Defaults" option, such as to change the current default for door system user interface 16 back to the factory default settings, or to change from the factory default settings to a set of custom settings.

The View Firmware/Status Screen 130 provides the "System Info" option for displaying at display panel 34 the system information, such as the firmware version for door system user interface 16, the firmware version for door controller 18, etc.

The Reset Soft Switch Screen 132 provides the "Restart" option, which when selected reboots the door system user interface 16.

Thus, the door system user interface 16 provides a versatile user interface device, which provides user options for automatically controlling the door operation mode at door controller 18 previously not available, as well as providing real-time status information, and error logging for door controller 18. Advantageously, door system user interface 16 facilitates automatic selection of the door operation mode (e.g., Automatic, Exit Only, Closed and Locked, etc.) at the door controller 18 of the automatic door system 10 based on the programmed schedule residing in door system user interface 16 and the current date and current time. Also, advantageously, door system user interface 16 allows the user to set dynamic modes to comply with environmental mandates of organizations. For example, in order to reduce energy costs, the door system user interface 16 may maintain the door 12 in a "held open" state for a period of time, but then automatically revert to normal operation at the conclusion of this period.

While this invention has been described with respect to embodiments of the invention, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An automatic door system for operation of a door, comprising:

a door controller, the door controller being a programmable device configured with a plurality of selectable door operation modes;

a door driver mechanism electrically coupled to the door controller, and operatively coupled to the door, the door driver mechanism including a motor and a mechanical drive linkage configured to generate an electromotive force to operate the door;

at least one sensor electrically coupled to the door controller, each sensor being configured to detect a predetermined type of event and to provide a respective sensor signal to the door controller upon occurrence of a respective predetermined type of event; and a door system user interface communicatively coupled to the door controller, the door system user interface having an input panel and a display panel, and having a processor unit electrically coupled to the input panel and the display panel, the processor unit including a memory device configured to store a plurality of door operation schedules, with each door operation schedule having an execution date, an execution time, and a predetermined door operation mode of the plurality of selectable door operation modes, the processor unit being configured to execute program instructions to:

monitor a current date and current time;

select as an active operation schedule the door operation schedule of the plurality of door operation schedules having the execution date and the execution time that corresponds to the current date and the current time, select at the door controller the door operation mode corresponding to the predetermined door operation mode of the active operation schedule, and change from a current active operation schedule to a next door operation schedule of the plurality of door operation schedules when a next execution date and a next execution time of the next door operation schedule corresponds to the current date and the current time, wherein none of the plurality of door operation schedules designates an ending date and an ending time.

2. The automatic door system of claim 1, wherein the execution date is a day in a seven day weekly cycle, and a time of duration of at least one door operation schedule is less than 24 hours based on the next execution date and the next execution time of the next door operation schedule.

3. The automatic door system of claim 1, wherein the execution date is a day in a seven day weekly cycle, and a time of duration of at least one door operation schedule is greater than 24 hours based on the next execution date and the next execution time of the next door operation schedule.

4. The automatic door system of claim 1, wherein the date is a day in a one month cycle and the plurality of door operation schedules are continuous over the one month cycle, and a time of duration of at least one door operation schedule is less than 24 hours based on the next execution date and the next execution time of the next door operation schedule.

5. The automatic door system of claim 1, wherein the date is a day in a one month cycle and the plurality of door operation schedules are continuous over the one month cycle, and a time of duration of at least one door operation schedule is greater than 24 hours based on the next execution date and the next execution time of the next door operation schedule.

6. The automatic door system of claim 1, wherein the date is a day in a one year cycle and the plurality of door operation schedules are continuous over the one year cycle, and a time of duration of at least one door operation schedule is less than 24 hours based on the next execution date and the next execution time of the next door operation schedule.

7. The automatic door system of claim 1, wherein the date is a day in a one year cycle and the plurality of door operation schedules are continuous over the one year cycle, and a time of duration of at least one door operation schedule is less than 24 hours based on the next execution date and the next execution time of the next door operation schedule.

8. The automatic door system of claim 1, wherein the memory device is configured to store a group of door operation schedules that are continuous over a predetermined time period, and the processor unit is configured to execute program instructions to individually select each door operation schedule of the group of door operation schedules during the predetermined time period based on the execution date and the execution time of each door operation schedule in the group of door operation schedules.

9. The automatic door system of claim 8, wherein the predetermined time period is a holiday period.

10. The automatic door system of claim 1, wherein the plurality of door operation modes includes at least two of:

an automatic mode wherein the door opens and closes automatically based on a sensor output from the at least one sensor;

a reduced automatic mode in which the door is only partially opened during automatic operation;

a hold open mode in which the door is opened and remains open;

a one-way mode in which the door is operable for one of ingress or egress, but not the other egress or ingress;

a reduced one-way mode in which the door is only partially opened during one-way operation for ingress or egress;

a safe-while-closing mode in which the door controller operates in a prior door operation mode with regards to sensor outputs until the door is closed, and when the door is closed the door remains closed; and a close mode in which the door is closed without regard to sensor outputs and remains closed.

11. The automatic door system of claim 10, wherein the hold opening mode includes a temporary hold open mode and a permanent hold open mode, wherein the temporary hold open mode maintains the door in an open condition for a predetermined amount of time.

12. The automatic door system of claim 1, wherein the input panel of the door system user interface includes at least one input button configured to receive user input to request modification of the door operation schedule, the processor unit being configured to receive the user input and execute program instructions to select a desired date, a desired time and a desired door operation mode to be associated with a respective door operation schedule to be modified.

13. The automatic door system of claim 1, wherein the door controller is configured to identify a current status of the door controller, and the door system user interface is configured to poll the door controller to retrieve the current status from the door controller, the processor unit of the door system user interface being configured to display the current status on the display panel of the door system user interface.

14. The automatic door system of claim 1, wherein the door system user interface is configured to retrieve and display information associated with door errors identified by the door controller.

15. The automatic door system of claim 14, wherein the door system user interface is configured to poll the door controller for the occurrence of the door errors, the processor unit of the door system user interface being configured to receive a current door error from the door controller and display the current door error on the display panel of the door system user interface.

16. The automatic door system of claim 1, wherein the door controller is configured to identify door errors, and the door system user interface is configured to poll the door controller to log information associated with the door errors in an event log in the memory device of the door system user interface, and wherein the input panel of the door system user interface includes at least one input button configured to receive a user input requesting retrieval of information from the event log stored in the memory device, the processor unit being configured to receive the user input and execute program instructions to retrieve at least a portion of the event log from the memory device for display on the display panel of the door system user interface.

17. A door system user interface configured for communication with a door controller of an automatic door system, the door controller being a programmable device configured with a plurality of selectable door operation modes associated with operation of a door, the door system user interface comprising:

an input panel configured to receive user input;

a display panel configured to display information associated with the automatic door system; and a processor unit communicatively coupled to the input panel and to the display panel, the processor unit including, a microprocessor system, an electronic memory device, and an Input/Output module, the electronic memory device having stored therein a plurality of door operation schedules, with each door operation schedule having an execution date, an execution time, and a predetermined door operation mode of the plurality of selectable door operation modes, and the processor unit being configured to execute program instructions to:

monitor a current date and current time;

select from the electronic memory device as an active operation schedule the door operation schedule of the plurality of door operation schedules having the execution date and the execution time that corresponds to the current date and the current time, send a signal from the Input/Output module to the door controller to select at the door controller the door operation mode corresponding to the predetermined door operation mode of the active operation schedule, and change from a current active door operation schedule to a next door operation schedule of the plurality of door operation schedules when a next execution time and a next execution date of the next door operation schedule corresponds to the current date and the current time, and the processor unit being configured to send a next selection signal from the Input/Output module to the door controller to select at the door controller the predetermined door operation mode corresponding to the next door operation schedule of the plurality of door operation schedules, wherein the current active door operation schedule does not designate an ending date and an ending time.

18. The door system user interface of claim 17, wherein the memory device is configured to store a group of door operation schedules that are continuous over a predetermined time period, and the processor unit is configured to execute program instructions to individually select each door operation schedule of the group of door operation schedules during the predetermined time period based on the execution date and the execution time of each door operation schedule in the group of door operation schedules.

19. The door system user interface of claim 17, wherein the input panel includes at least one input button configured to receive user input to modify a respective door operation schedule of the plurality of door operation schedules, the processor unit being configured to receive the user input and execute program instructions to select a desired date, a desired time and a desired door operation mode to be associated with the respective door operation schedule.

20. The door system user interface of claim 17, wherein the door system user interface is configured to poll the door controller to retrieve a current door controller status, and the processor unit of the door system user interface is configured to display the current door controller status on the display panel.

21. The door system user interface of claim 17, wherein the door system user interface is configured to retrieve from the door controller and display information associated with a door error identified by the door controller.

22. The door system user interface of claim 17, wherein the door system user interface is configured to poll the door controller for the occurrence of door errors, and the processor unit is configured to receive a current door error from the door controller and display the current door error on the display panel.

23. The door system user interface of claim 22, wherein the door system user interface is configured to log information associated with the door errors in an event log in the electronic memory device, and wherein the input panel includes at least one input button configured to receive a user input requesting retrieval of information from the event log and the processor unit is configured to execute program instructions to retrieve at least a portion of the event log from the memory device for display on the display panel.

24. A method for automatically selecting a door operation mode of a plurality of selectable door operation modes at a door controller of an automatic door system, comprising:

providing a door system user interface in communication with the door controller;

providing a plurality of door operation schedules stored in the door system user interface, with each door operation schedule having an execution date, an execution time, and a predetermined door operation mode of the plurality of selectable door operation modes, and wherein each door operation schedule does not include an ending date or an ending time;

monitoring a current date and current time;

selecting as an active operation schedule the door operation schedule of the plurality of door operation schedules having the execution date and the execution time that corresponds to the current date and the current time;

sending a signal from the door system user interface to the door controller to select at the door controller the door operation mode corresponding to the predetermined door operation mode of the active operation schedule; and changing from a current active operation schedule to a next door operation schedule of the plurality of door operation schedules when a next execution date and a next execution time of the next door operation schedule corresponds to the current date and the current time.

25. The method of claim 24, comprising:

polling the door controller for the occurrence of door errors;

receiving at the door system user interface a current door error from the door controller; and displaying the current door error on the door system user interface.

26. The method of claim 25, comprising logging each door error of the received door errors in an event log in an electronic memory device of the door system user interface.

27. The method of claim 26, comprising:

receiving a user input requesting retrieval of information from the event log; and retrieving at least a portion of the event log from the electronic memory device for display on the door system user interface.

* * * * *